US006888311B2

(12) United States Patent
Hirao

(10) Patent No.: US 6,888,311 B2
(45) Date of Patent: May 3, 2005

(54) ULTRAHIGH PRESSURE MERCURY LAMP WITH AN ANODE CONFIGURED TO HAVE A HIGH THERMAL CAPACITY

(75) Inventor: Tetsuji Hirao, Hyogo-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 36 days.

(21) Appl. No.: 10/406,389

(22) Filed: Apr. 4, 2003

(65) Prior Publication Data

US 2003/0189407 A1 Oct. 9, 2003

(30) Foreign Application Priority Data

Apr. 5, 2002 (JP) ..... 2002-103742

(51) Int. Cl.[7] ..... H01J 17/04; H01J 61/04

(52) U.S. Cl. ..... 313/631; 313/634; 313/637; 313/639; 313/621; 313/623; 313/642; 362/216; 362/217

(58) Field of Search ..... 313/631–634, 313/639, 571, 621–623; 362/216, 217

(56) References Cited

U.S. PATENT DOCUMENTS 4,439,711 A * 3/1984 Murakami et al. ..... 313/487
5,109,181 A 4/1992 Fischer et al.
5,497,049 A 3/1996 Fischer
5,663,607 A * 9/1997 Kira et al. ..... 313/284
6,274,983 B1 * 8/2001 Ooyama et al. ..... 313/632
6,294,870 B1 * 9/2001 Kawashima et al. ..... 313/623
6,661,176 B2 * 12/2003 Honda et al. ..... 315/56
6,667,575 B2 * 12/2003 Nishida ..... 313/631

FOREIGN PATENT DOCUMENTS

JP 11-111226 4/1999
JP 2001-319618 11/2001

* cited by examiner

*Primary Examiner*—Nimeshkumar D. Patel
*Assistant Examiner*—Sikha Roy
(74) *Attorney, Agent, or Firm*—Nixon Peabody LLP; David S. Safran

(57) ABSTRACT

An ultrahigh pressure mercury lamp which is small and has high light radiation intensity and moreover good color reproduction with high efficiency in which, even with a large amount of mercury added, a failure of the mercury to vaporize in the bulb part does not occur, and in which blackening of the bulb part due to wearing of the electrodes even under a large electrode load as a result of shortening of the distance between the electrodes is low is obtained by an ultrahigh pressure mercury lamp in which a bulb part of the discharge vessel made of translucent material has an essentially ovoid shape, is filled with at least 0.2 mg/mm$^3$ of mercury and which is operated at an input wattage of at most 400 W using direct current, has the length D of the tip area of the anode and the length L of the bulb part in the direction of the tube axis of the lamp set in accordance with the relationship D≧L/2.

7 Claims, 8 Drawing Sheets

Fig. 3 (a)
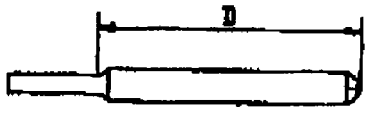
Fig. 3 (c)
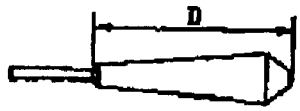
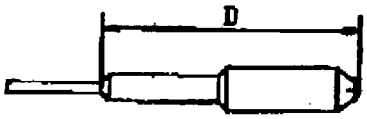
Fig. 3 (b)
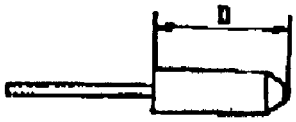
Fig. 3 (d)

ULTRAHIGH PRESSURE MERCURY LAMP WITH AN ANODE CONFIGURED TO HAVE A HIGH THERMAL CAPACITY

BACKGROUND OF THE INVENTION

1. Field of the Invention

The invention relates to an ultrahigh pressure mercury lamp, and especially to an ultrahigh pressure mercury lamp which is used as the light source for a projection device of the projection type, such as a liquid crystal projector or the like.

2. Description of the Related Art

In a light source which is used for a liquid crystal projector or the like, the emitted light is projected by means of a reflector in one direction and is emitted onto a screen by an optical system, such as a lens and the like. It is desirable for this light source to be as nearly as possible a point light source. However, in practice, there is a certain size which is determined by the distance between the electrodes of the lamp which is the light source. If the size of this light source is considered to be approximately a point light source, the lamp can be imagined as an ideal lamp in which the bulb part has a uniform thickness and is made spherical and in which the middle of the arc which is formed within this bulb by a discharge that is located in the center of the bulb part.

However, in the case, for example, of an ultrahigh pressure mercury lamp which is driven using a direct current, the sizes of the anode and the cathode which are located in the bulb of this lamp differ largely from one another. This is because, in the case of driving using a direct current, the amount of heat which is formed in the respective electrode is to a large extent varied. Therefore, the anode is made larger than the cathode with consideration of this amount of heat. In order to place these electrodes within a discharge vessel, differently than in the case of the above described ideal lamp, for example, the measure described in Japanese patent disclosure document HEI 11-111226 that the bulb part is made essentially as an ovoid, or other measures are taken.

FIG. 10 shows a conventional ultrahigh pressure mercury lamp in which the bulb part is essentially an ovoid of circular cross section. A bulb part 51 is made of a translucent material, such a silica glass or the like. Extending from opposite ends of the bulb part 51 are side tube parts 52. The bulb part 51 and the side tube parts 52 form a discharge vessel 50 in which an anode electrode 53 is disposed opposite a cathode 54 electrode. Each of the anode and cathode electrodes 53, 54 is welded to an end of a respective metal foil 55 made of molybdenum or the like. An outer lead 56 is welded on the other end of each metal foil 55. The inside of this discharge vessel 50 is an ovoid as was described above. Furthermore, in addition to anode and cathode electrodes 53, 54, this discharge vessel 50 is filled with a rare gas and mercury in an amount of roughly 0.15 $mg/mm^3$. Additionally, an arrangement is made in which the middle of the arc which forms between the anode and cathode electrodes 53, 54 coincides with the middle of the bulb part 51, at which the maximum diameter of the bulb part 51 is located. The distance between the electrodes is, for example, 1.5 mm.

There is market demand for further increasing the radiance of this lamp. The improvement has been made that, by shortening the distance between the electrodes of this lamp, the input wattage per unit of distance between the electrodes is increased and thus the radiance is increased, or that the diameter of the arc is reduced by further increasing the amount of mercury to be added to the discharge vessel and that the radiance is thus increased.

However, in the case in which the amount of mercury to be added to the discharge vessel has been increased even more, when for example roughly 0.17 $mg/mm^3$ are added, the mercury in the vicinity of the base point on the cathode side in the discharge space is not yet vaporized. Therefore, the failure of the mercury to be vaporized has been corrected by the middle position of the arc being pushed out of the area with the maximum diameter of the bulb part which is the middle of the bulb part, towards the cathode side. With this measure the not yet vaporized mercury is thus heated and caused to vaporize by the arc as the heat source approaching the vicinity of the base point of the cathode.

With respect to the radiation intensity which is required by the market, there is a demand for a lamp with a greater radiance and good color reproduction. Furthermore, there is a demand for making the lamp itself smaller. However, if the amount of mercury to be added to the conventional lamp is increased even more and is fixed at least 0.2 $mg/mm^3$, the disadvantage occurs that in the remaining area, for example, at the base point of the anode, the mercury fails to vaporize, even if the position of the arc in the discharge vessel is shifted to the cathode side. Additionally, there is also the disadvantage that the arc becomes unstable and flickering occurs. This is caused by the following:

The mercury which has not vaporized collects and contracts. If the grain size of this mercury reaches a certain magnitude, especially roughly 0.2 mm or more, a cycle forms in which the mercury is moved by gravity to the area with the maximum inside diameter and vaporizes and then mercury condenses again on the base point of the anode. For this reason, convection within the lamp fluctuates.

If, by shortening the distance between the electrodes, the attempt is made to obtain high radiation intensity, the amount of heat flowing into these electrodes is large, and especially the wear on the anode is very great, resulting in the disadvantage that the service life of the lamp is shortened. On the other hand, it can be imagined that the volume of the anode itself increases in order to suppress the heat influence on the anode. However, there was the disadvantage that by increasing the diameter of the anode part, the diameter of the bulb part increases and that the demand for reducing the size of the lamp cannot be satisfied.

SUMMARY OF THE INVENTION

The primary object of the present invention is to devise an ultrahigh pressure mercury lamp which is small and has high light radiation intensity, and moreover, good color reproduction.

Furthermore, another object of the invention is to devise an ultrahigh pressure mercury lamp with high efficiency in which, even with a large amount of mercury added, a failure of the mercury to vaporize in the bulb part does not occur, and in which blackening of the bulb part due to wearing of the electrodes, even under a large electrode load as a result of shortening of the distance between the electrodes, is low.

These objects are achieved in an ultrahigh pressure mercury lamp in which a discharge vessel that is formed of a translucent material has essentially the shape of an ovoid from each end of which side tube parts, and in which opposed anode and cathode electrodes are located opposite together with at least 0.2 $mg/mm^3$ of mercury. The lamp is operated with aninput wattage of at most 400 W using direct current, and a relationship $D \geqq L/2$ is set between the length D of the tip area of the anode and the length L of the bulb part in the direction of the tube axis of the lamp.

Due to this arrangement in which the anode has a length which is equal to at least half of length of the bulb part in the direction of the tube axis, the thermal capacity of the anode becomes great. This prevents the anode itself from deforming and/or the service life of the ultrahigh pressure mercury lamp from being shortened, because the amount of vaporization of the electrode material from the anode is low. Furthermore, there is the advantage that the anode becomes a heat source and that, on the anode side, failure of the mercury to vaporize hardly occurs even if at least 0.2 $mg/mm^3$ of mercury is added.

The indicated objects are achieved, furthermore, in an ultrahigh pressure mercury lamp in accordance with the invention in that there is a gap between the inside wall of the side tube part and the anode which is located on the inside of this side tube part, that the diameter d of the anode which is located on the inside of the side tube part has a thickness in the range from $0.5\ ID \leqq d \leqq 0.95\ ID$ with respect to the inside diameter ID of this side tube part and that the volume V ($mm^3$) of the tip area of the anode with respect to the input wattage P(W) meets the following condition:

$$V/P \geqq 0.12.$$

This arrangement prevents the temperature of the tip area of the anode from increasing to an extreme degree, if the color reproduction and the radiation intensity are improved. Therefore, the anode tip is prevented from deforming or melting to a large extent. Furthermore, the amount of vaporization of the anode material from the anode tip area is reduced, by which the blackening of the bulb part of the lamp is suppressed. As a result, shortening of the service life is prevented. Furthermore, since, at a diameter of the anode located in the side tube part of less than 50% of the inside diameter of the side tube part, the amount of heat flowing in from the tip area of the anode cannot be transferred to a sufficient degree, the temperature of the anode tip area cannot be reduced enough. As a result the service life characteristic cannot be satisfied. At an anode diameter of greater than 95% of the inside diameter of the side tube part, it is difficult to insert an anode through the side tube part if the anode is located within the bulb part. This case is therefore not practical.

Furthermore, these objects are achieved in accordance with the invention in that the wall load P/S ($W/mm^2$) meets the following condition which is described by the ratio of the inside area S ($mm^2$) of the bulb part, which is described by $\pi \times L \times A$, to the input power P(W) in the range of $L \leqq 2.5 \times A$:

$$P/S \geqq 1.2,$$

where L is the length (mm) of the bulb area in the axial tube direction of the lamp and A is the maximum inside diameter of the bulb (mm) in the direction which orthogonally intersects the axial direction of the lamp tube.

In this way, in an ultrahigh pressure mercury lamp which is filled with at least 0.2 $mg/mm^3$ of mercury, the unvaporized mercury is prevented from remaining in the bulb part, and thus, an advantageous optical characteristic is obtained.

The objects are also achieved in accordance with the invention in an ultrahigh pressure mercury lamp in that there is a heat insulation means on the outside surface of the side tube part. The heat insulation means of the side tube part prevents accumulation of mercury even if cohesion of the mercury which fills the discharge vessel occurs in the side tube part with a low temperature. The mercury vapor pressure in the lamp can thus be kept constant and high radiation intensity and good color reproduction obtained. Furthermore, the disadvantage of flickering of the emitted light as a result of fluctuation of the inside pressure of the lamp by mercury which has not been vaporized is avoided.

In such a case of adding mercury with a high density of at least 0.2 $mg/mm^3$, the shape of the bulb part can be optimized, and moreover, by thermal insulation of the side tube part, a light source with high radiance can be devised in which the mercury does not fail to vaporize. Even in the worst case, in which variances in processing and cooling cause failure to vaporize, it is desirable for the location at which vaporization fails to occur to be located in the area with the maximum inside diameter of the bulb part because, in this case, a major pressure fluctuation does not occur.

As means for confirming the locations at which vaporization of the mercury fails to occur, in horizontal operation, only 70% of the nominal input wattage is used without using a compressed air cooling means. This means has confirmed the locations at which vaporization of the mercury of the ultrahigh pressure mercury lamp according to the invention failed to occur. Here, unvaporized mercury was essentially confirmed in the area with the maximum inside diameter of the bulb part. That is, in the ultrahigh pressure mercury lamp of the invention, there is no arc instability even if the vaporization of the mercury fails to occur.

The above objects is also achieved in an ultrahigh pressure mercury lamp in that part of the anode portion is held indirectly via the inside glass wall of the side tube part and a holding component.

For this reason, the disadvantage that the upholding part of the anode breaks, or a similar disadvantage, does not occur even if the anode is an anode which is long in the longitudinal direction and which is in contact with part of the side tube part. Even if, during transport of the lamp or the like, vibration is active, the glass tube is prevented from being scratched due to collision of the anode with the side tube part or for similar reasons. Therefore, the lamp is prevented from being destroyed even if the operating pressure is high.

As was described above, in accordance with the invention, by increasing the length D of the anode part, the diameter of the anode part need not be unnecessarily increased. Thus, wear of the tip area of the anode can be largely suppressed. As a result, while ensuring the initial light flux quantity, a reduction of the light flux quantity in the solid capture angle, as a result of lengthening the distance between the electrodes, which is caused by wear can be suppressed. Furthermore, largely reducing the spray of the anode material which splatters from the tip area of the anode, for example, tungsten, is achieved, and thus, less tungsten adheres to the inside wall of the bulb part. Thus, blackening and devitrification of the bulb part can be suppressed. Furthermore, an advantageous surface life characteristic can be obtained without unnecessarily increasing the size of the bulb part at the respective input wattage.

The invention is described below using several embodiments which are shown in the drawings.

BRIEF DESCRIPTION OF THE DRAWINGS

FIGS. 3(*a*) to 3(*d*) each show a schematic of the anode shape and the length of the tip area of the anode in accordance with the invention;

DETAILED DESCRIPTION OF THE INVENTION

Figure 1:
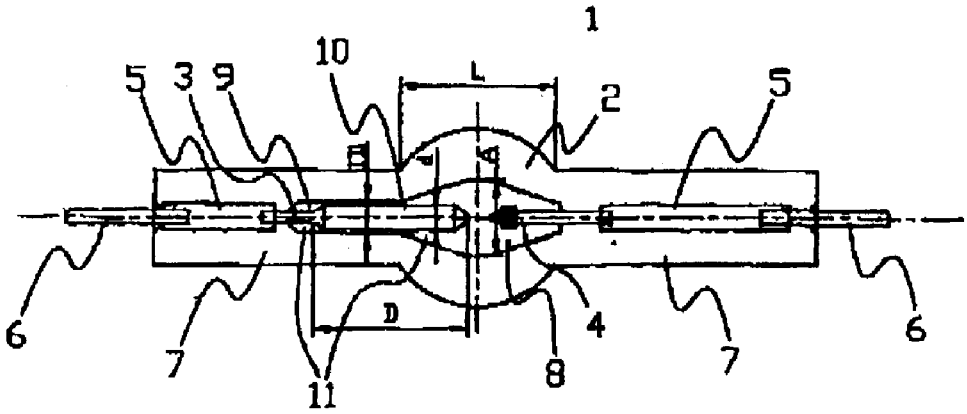
FIG. 1 is a schematic view of a first embodiment of an ultrahigh pressure mercury lamp in accordance with the invention.

FIG. 1 schematically shows a first embodiment of an ultrahigh pressure mercury discharge lamp. In the figure, the ultrahigh pressure mercury discharge lamp 1 in accordance with the invention has a bulb part 2 made of silica glass with a body in the shape of an ovoid. In this bulb part 2, anode and cathode electrodes 3, 4 made of tungsten are located opposite each other at a distance between them of 1.0 mm. One end of a respective metal foil 5 of molybdenum or the like is welded to the rear end of each of the electrodes 3, 4 and an outer lead line 6 is connected to the other end of each foil 5.

The maximum inside diameter A of the bulb part 2 represents the maximum inside diameter of the bulb part in the direction which orthogonally intersects the lamp tube axis between the electrodes. The maximum inside bulb diameter A is 4.8 mm. Furthermore, the bulb length L in the direction of the lamp tube axis of the bulb part 2 of an essentially ovoid body is 10.2 mm. Side tube parts 7 extend from each of opposite ends of the bulb part 2 in along the lamp tube axis. On the inside of the each side tube part 7, there is a side tube interior 9 which is connected to the bulb interior 8 and borders it. The side tube inside diameter ID, as the inside diameter of the side tube interior 9, is 2 mm. The length D of the tip area 10 of the anode 3 is 10 mm.

Both the diameter d of the anode tip area 10 which is located in the side tube part and also the maximum anode part diameter $d_{max}$ are 1.8 mm. The discharge space 11, which is formed by the combination of the bulb interior 8 and the side tube interior 9, is filled with $133\times10^2$ Pa Ar as the starting rare gas. Furthermore, the inside volume, including the electrode part of the discharge space 11, is 98 $mm^3$ and is filled with 0.25 $mg/mm^3$ of mercury and $2.5\times10^{-4}$ $\mu mol/mm^3$ of bromine as the halogen.

Figure 2:
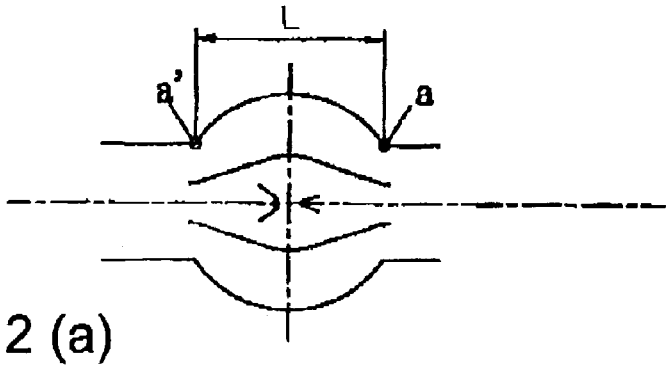
FIGS. 2(*a*) and 2(*b*) each shows a schematic of the bulb length L in the invention.
Figure 2:
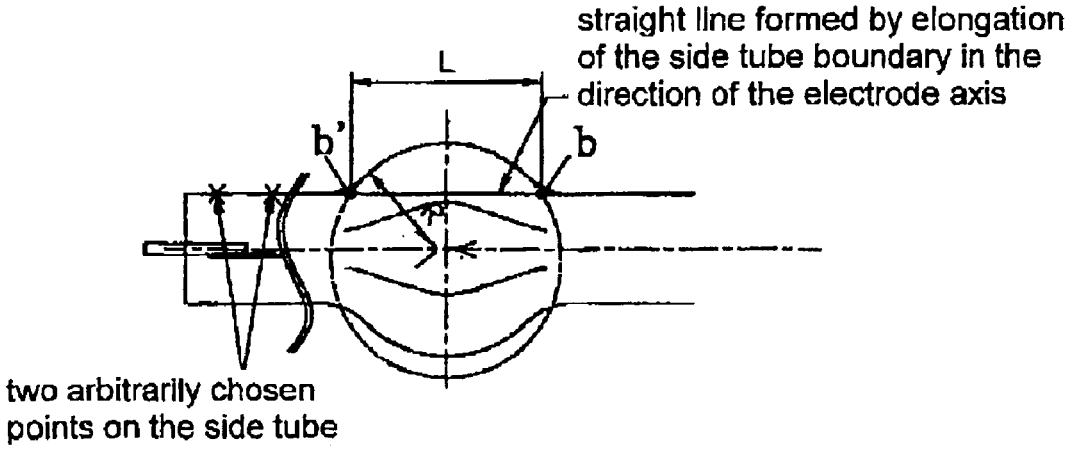

The bulb length L, as the length in the lamp tube axis direction of the bulb part 2, is described below using FIGS. 2(*a*) and 2(*b*). The expression "bulb length L" is defined as the length which is fixed by the respective limits of the bulb part 2 between the side tube parts 7 which project from the bulb part 2. FIG. 2(*a*) shows the case in which the boundary between the side tube part and the bulb part can be clearly distinguished. The distance between the points a and a' in FIG. 2(*a*) is called the bulb length L. However, there are also cases in which the coupling area between the bulb part 2 and the side tube part 7 is unclear. Such a case is shown in FIG. 2(*b*) and in this case the distance between points b and b' is called the bulb length L, the points b and b' being fixed by intersection points which are formed by a straight line between any two axially aligned points on the outer periphery of the side tube part 7 and by a circle which passes through the maximum inside bulb diameter of the bulb part and approaches the curved surface of the bulb part.

FIGS. 3(*a*) to 3(*d*) each show one example of fixing the length D of the tip area of the anode 3 and the anode shape. The term "length D" of the tip area of the anode is defined as the distance between the area with a greater outside diameter than at the rear end of the anode 3 which is jacketed in the side tube part by glass and the outermost tip of the anode 3 which is located opposite the cathode 4. FIGS. 3(*a*) to 3(*d*) each show one version of the anode shape, the area which corresponds to the length D of the tip area of the respective anode being shown using arrows in these figures.

In the first embodiment of the ultrahigh pressure mercury lamp 1 of the invention, the length D of the anode tip area is 10 mm and the bulb length L is 10.2 mm, D being longer than L/2. In this way, at an amount of at least 0.2 $mg/mm^3$ of mercury added to the discharge space 11, failure of the mercury to vaporize is prevented, and furthermore, vaporization of the electrode material from the anode is prevented.

Figure 4:
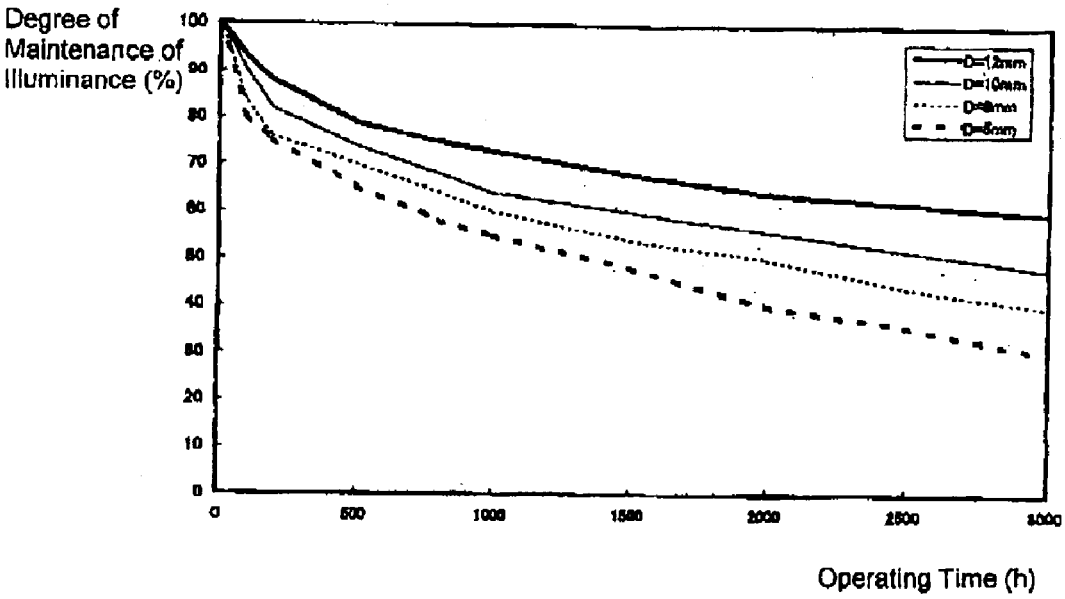
FIG. 4 is a graph depicting the relationship between the length of the anode tip area and the illuminance maintenance factor of an ultrahigh pressure mercury lamp in accordance with the invention.

In FIG. 4, the relation between the length D of the anode tip area and the illuminance maintenance factor of the ultrahigh pressure mercury lamp is shown. In the figure, the y-axis plots the illuminance maintenance factor (%) a percentage of the initial illuminance of the ultrahigh pressure mercury lamp represented as 100% and the x-axis plots the length of operation (hours h) of the ultrahigh pressure mercury lamp. In the ultrahigh pressure mercury lamp which was shown in the first embodiment of the invention, the length D of the anode tip area was changed, operation was carried out with an initial wattage of 200 W and the illuminance maintenance factor was compared. The comparison was performed for the lengths D of 5 mm, 8 mm, 10 mm and 12 mm of the anode tip area. As a result, at a length D of the anode tip area of at least 10 mm, an irradiance of at least 50% of the initial illuminance was maintained for 2500 hours of operation.

Figure 5:
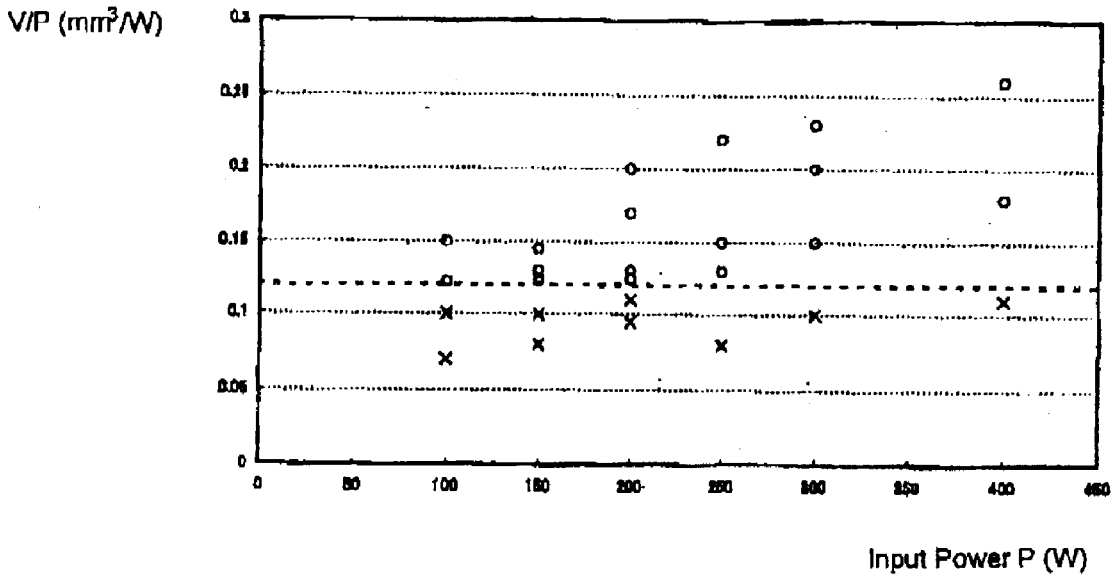
FIG. 5 is a graph depicting the relationship between the dimensions of the anode part which is necessary for suppression of the wear of the anode tip area, and the input wattage.

FIG. 5 shows the condition for suppression of the wear of the anode tip area based on the relation between the volume ($mm^3$) of the anode tip area in the area which corresponds to the length D (mm) of the anode tip area, and the input wattage of the ultrahigh pressure mercury lamp 1. Generally, the wear of the anode tip area is greater, the higher the temperature of the anode tip area. The temperature of the anode tip area is higher, the greater the current supplied to the anode. This current value has a tendency to increase more, the shorter the distance between the electrodes. On the other hand, the radiant efficiency is reduced as a result of a short emission length by the ultrahigh pressure mercury lamp of the invention in the case of a distance between the electrodes of less than 0.6 mm, by which it is impossible to remove a sufficient amount of light flux. Therefore, the condition for suppression of the wear of the anode tip area at a distance between the electrodes of 0.6 mm is checked. Several lamps with an amount of mercury added of 0.3 $mg/mm^3$ and different volumes V of the anode tip area were produced as the sample; the input wattage of 100 W to 400 W was changed and the service life of the respective lamp was checked.

In FIG. 5, the circles show that the required service life characteristic was satisfied as a result of the fact that wear of the anode tip area was suppressed. Furthermore, the crosses show that the anode tip area has been worn and that as a result the service life characteristic was not satisfied. The wear of the anode tip area was confirmed by confirming the shape by an x-ray device or the like and by the value of the voltage increase during operation. As a result, wear of the anode tip area can be suppressed if, with respect to the input wattage of at most 400 W, the relation V/P between the volume V of the anode tip area and the input wattage P is at least 0.12. This prevents shortening of the lamp service life by vaporization of the electrode material. Furthermore, there is the advantage that the voltage increase due to electrode wear during operation can be greatly reduced.

Figure 6:
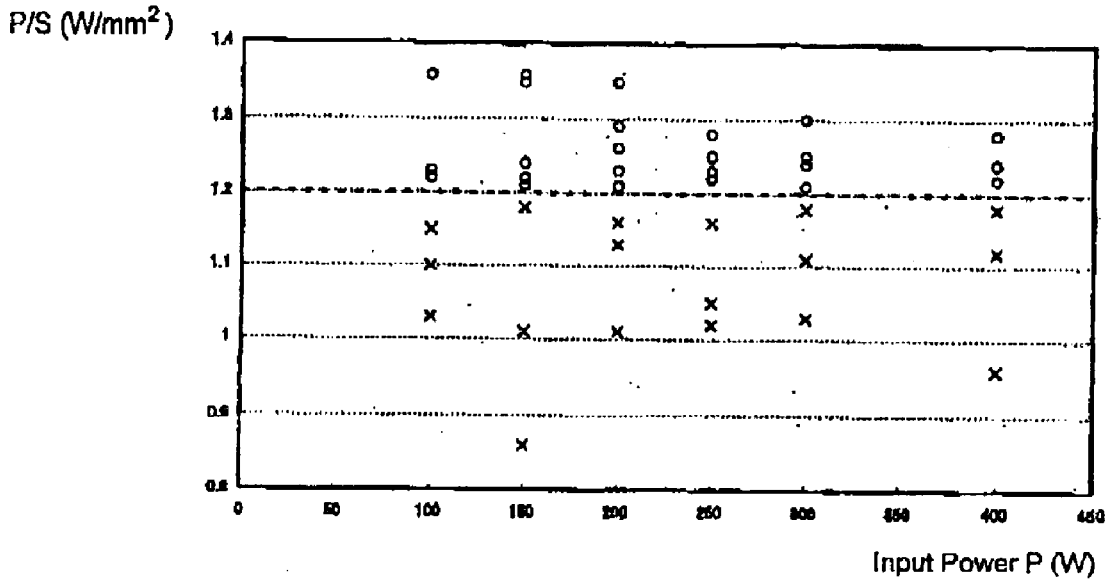
FIG. 6 is a graph depicting the relationship between the internal area of the bulb which is necessary to prevent failure of the mercury to evaporate, and the input wattage.

In FIG. 6, under the condition which is shown in FIG. 5 under which the anode is not worn, the condition was determined under which failure of vaporization of the mercury added to the discharge space does not occur during operation. In the ultrahigh pressure mercury lamp of the invention, the amount of mercury added to the discharge space for increasing the intensity of the radiant light is at least 0.2 $mg/mm^3$. However, at an increased amount of mercury, the added mercury fails to vaporize. The failure of the mercury to vaporize depends on the surface temperature within the bulb which depends on the internal area of the bulb. Therefore, of the entire discharge space, the size of the bulb interior is described by the internal area S ($mm^2$), the inside area of the bulb part having been roughly determined by $\pi \times L \times A$. As a result of the relation between the inside area S and the input wattage, the condition was determined under which the mercury does not fail to vaporize. The inside area S was fixed by the product of the bulb length L, the maximum bulb inside diameter A and $\pi$ (pi), an essentially ovoid shape having been assumed. FIG. 6 shows cases of occurrence or non-occurrence of failure of the mercury to vaporize at an input wattage of at most 400 W, the ultrahigh pressure mercury lamp having been produced with an amount of mercury of 0.3 $mg/mm^3$ at which the inside area S in the range of $L \leqq 2.5 \times A$ was changed.

In FIG. 6, the circles show case in which the mercury did not fail to vaporize in the bulb part. The crosses shows cases in which mercury did fail to vaporize in the bulb part. FIG. 6 also shows that failure of the mercury to vaporize is prevented when the relation between the inside area S and the input wattage P is $P/S \geqq 1.2$. As a result of the tests in the case of $L > 2.5 \times A$, a lamp resulted in which, even at $P/S \geqq 1.2$, the mercury fails to vaporize. It can be imagined that this occurred as follows:

When the bulb length L becomes greater than necessary, as a result of the distance from the arc as the heat source in the vicinity of the base point of the electrode, an area with a low temperature is formed in which mercury failed to vaporize.

Figure 7:
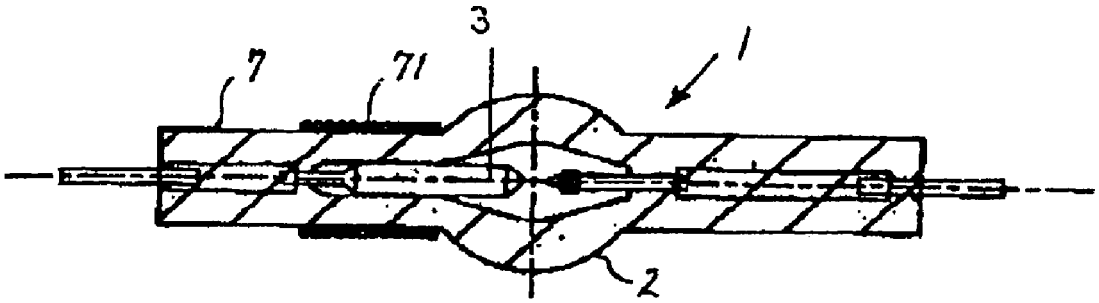
FIG. 7 is a schematic cross section of an embodiment in which in which heat insulation means is provided in accordance with the invention.

FIG. 7 is a cross section which shows a second embodiment of the ultrahigh pressure mercury lamp 1 in accordance with the invention. Here, the side tube part 7 on the side of the anode 3 of the ultrahigh pressure mercury lamp 1 is wound with a metallic wire 71 as the heat insulation means. In this case, the metallic wire 71 absorbs the heat radiated by the bulb part 2, and the side tube part 7 is thermally insulated by the radiant heat of the metallic wire 71 itself.

As another heat insulation means, a heat insulating film of a material on an inorganic base, such as aluminum oxide or the like, can be formed on the area which has been wound with the metallic wire 71, or an opaque glass area can be formed in the side tube part. When there is a heat insulation film in place, by diffuse reflection of the light emitted from the heat insulation film the thermal insulation of this side tube part 7 can be carried out. When the side tube part 7 is formed from opaque glass, heat insulation of the side tube part 7 is carried out because the light is diffusely reflected by the outside surface of the side tube part 7.

Due to the heat insulation of the side tube part 7, on the end of the anode 3 by such a heat insulation means, failure of the mercury to vaporize no longer occurs in the side tube part 7 with a temperature which is lower than in the bulb part 2. Even if, as a result of variances in production, failure of the mercury to vaporize occurs, it occurs in the area with the maximum inside diameter of the bulb part. This prevents arc instability which causes a change of convection as a result of condensation and vaporization of the mercury. Thus, stable and high radiation intensity can be obtained.

Figure 8:
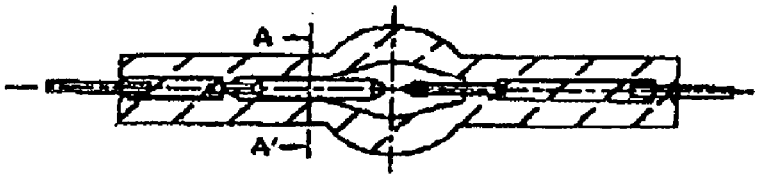
FIGS. 8(*a*) & 8(*b*) are longitudinal and transverse schematic cross sections, respectively, of an embodiment in which a holding component is provided in accordance with the invention, FIGS. 9(*a*) & 9(*b*) are longitudinal and transverse schematic cross sections, respectively, of another embodiment in which a holding component is provided in accordance with the invention.
Figure 8:
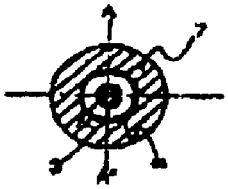

The above described anode holding means is shown using FIGS. 8(*a*) and 8(*b*). The anode often breaks in the vicinity of the boundary area to the glass on the side of the sealed area. It can be imagined that the reason for this is that the weight of the tip area of the anode is great, and that the load which is applied in the vicinity of the sealed area becomes large. Therefore, it is useful to place a holding component in the vicinity of the base point of the anode with a high degree of occurrence of breaking and in the tip area of the anode which causes formation of a bending moment. FIGS. 8(*a*) and 8(*b*) show a first embodiment in which the anode holding component is located in the tip area of the anode or at the base point of the anode. Here, the interior 9 of the side tube is shown in a lengthwise cross section and a transverse cross section. In FIGS. 8(*a*) and 8(*b*), in one area (cross section A–A') which represents the tip area of the anode 3 and which is located in the side tube part, there is a holding component 81. The holding component 81 is formed of two rings, specifically a large one and a small one, and of a linear part which connects these ring parts to one another and which is formed, for example, of tungsten wire. On the inside of the small ring, the anode 3 is installed. The anode 3 is attached by the outside of the large ring coming into contact with the inside of the side tube part.

Figure 9:
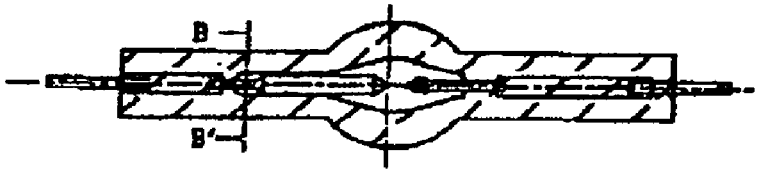
Figure 9:
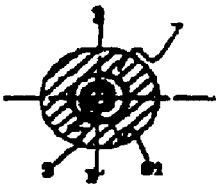
Figure 10:
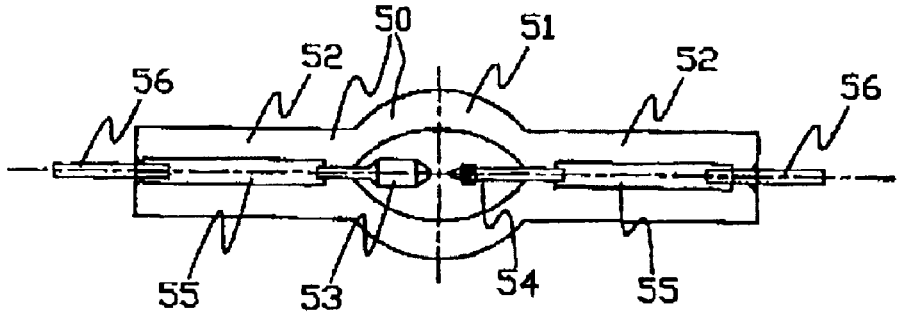
Fig. 10 (Prior Art)
FIG. 10 is a schematic cross-sectional view of a conventional ultrahigh pressure mercury lamp.

FIGS. 9(*a*) & 9(*b*) shows a case in which, in the vicinity of the base point of the anode (cross section B–B'), there is a holding component and in which the anode part is attached by there being a coil-like component made, for example, of tungsten wire proceeding from the outside diameter of the anode in the direction toward the inside of the side tube part, such as a helical spring or the like. This holding component can be installed in the tip area of the anode, in the vicinity of the base point on the side of the sealed area of the anode, or at both these points.

Due to the arrangement of the holding component shown in FIGS. 8 and 9, the disadvantage that the anode breaks as a result of an external force such as vibration or the like, or a similar disadvantage never occurs, even if the anode which is located within the ultrahigh pressure mercury lamp becomes large.

ACTION OF THE INVENTION

In the ultrahigh pressure mercury lamp in accordance with the invention, the anode has a length equal to at least half the length of the bulb part in the direction of the tube axis. Therefore, the thermal capacity of the anode can be made large. The anode itself is prevented from deforming or the service life of the ultrahigh pressure mercury lamp is prevented from being shortened because vaporization of the electrode material from the anode does not occur. Furthermore, there is the advantage that the anode itself becomes a heat source and that failure of the mercury to vaporize hardly ever occurs even if at lest 0.2 mg/mm$^3$ of mercury has been added. Additionally, the arrangement of the invention, even for a large amount of mercury added of at least 0.2 mg/mm$^3$, prevents unvaporized mercury from forming in the bulb part, and thus, an advantageous optical characteristic is obtained. Still further, there is the action that blackening of the bulb part or the like by wearing of the electrodes is low, even under a large electrode load, by shortening the distance between the electrodes, and that moreover, the bulb part can be made small. In addition, there are the advantages that, due to the arrangement of the heat insulation means in the area of the side tube part, the mercury does not fail to vaporize even if there is mercury cohesion in the side tube part, that the pressure during operation is kept in a constant range, and that the emitted light does not flicker. Furthermore, the arrangement of the holding component for fixing the anode prevents the anode from breaking by vibration or the like. Also, since the holding component is attached using the inside of the side tube part, collision of the anode with the inside of the side tube part is prevented and there is the action that the inside surface is not scratched, and therefore, does not break.

I claim:

1. Ultrahigh pressure mercury lamp, comprising:

a discharge vessel having a bulb part of translucent material in essentially the shape of an ovoid and side tube parts which extend along a tube axis from opposite sides of the bulb part, the discharge vessel being filled with at least 0.2 mg/mm$^3$ of mercury;

opposed anode and cathode electrodes disposed in the discharge vessel;

wherein the anode has a tip area and rear end, the tip area having a larger diameter than the rear end, and part of the tip area is located in a respective one of the side tube parts;

wherein the lamp is adapted for operation at an input wattage of at most 400 W using direct current, and wherein the length D (mm) of a tip area of the anode and a length L (mm) of the bulb part in a direction of the tube axis of the lamp is set in accordance with the relationship $D \geqq L/2$.

2. Ultrahigh pressure mercury lamp as claimed in claim 1, wherein a heat insulation means is provided on an outside surface of a one of the side tube parts which extends from an anode side of the bulb part.

3. Ultrahigh pressure mercury lamp as claimed claim 1, wherein a part of the anode is held by a holding part which is supported on an inside glass wall of a respective one of the side tube parts.

4. Ultrahigh pressure mercury lamp, comprising:

a discharge vessel having a bulb part of translucent material in essentially the shape of an ovoid and side tube parts which extend along a tube axis from opposite sides of the bulb part, the discharge vessel being filled with at least 0.2 mg/mm$^3$ of mercury;

opposed anode and cathode electrodes disposed in the discharge vessel;

wherein the lamp is adapted for operation at an input wattage of at most 400 W using direct current;

wherein the length D (mm) of a tip area of the anode and a length L (mm) of the bulb part in a direction of the tube axis of the lamp is set in accordance with the relationship $D \geqq L/2$; and wherein a gap is provided between a part of the anode which is located inside of a respective one of the side tube parts and the respective side tube part, wherein the part of the anode which is located inside of the respective side tube part has a diameter d (mm) in the range of $0.5\ ID \leqq d \leqq 0.95\ ID$ with respect to an inside diameter ID (mm) of the respective side tube part, and wherein a volume V (mm$^3$) of the tip area of the anode with respect to the input wattage P(W) meets the condition:

$$V/P \geqq 0.12\ (\mathrm{mm}^3/W).$$

5. Ultrahigh pressure mercury lamp as claimed in claim 4, wherein a wall load P/S (W/mm$^2$) meets the condition $P/S \geqq 1.2$ where P/S is a ratio of the input wattage P(W) to an inside area S (mm$^2$) of the bulb part which is defined by $\pi \times L \times A$ in a range of $L \geqq 2.5 \times A$ and where L (mm) is the length of the bulb area in the axial tube direction of the lamp and A (mm) is a maximum inside diameter of the bulb in a direction which orthogonally intersects the tube axis.

6. Ultrahigh pressure mercury lamp as claimed in claim 5, wherein a heat insulation means is provided on an outside surface a one of the side tube parts which extends from an anode side of the bulb part.

7. Ultrahigh pressure mercury lamp as claimed claim 6, wherein a part of the anode is held by a holding part which is supported on an inside glass wall of the respective side of one tube part.

* * * * *